US010251219B2

(12) United States Patent
Qian et al.

(10) Patent No.: US 10,251,219 B2
(45) Date of Patent: Apr. 2, 2019

(54) DEFROSTING GLASS, DEFROSTING LAMP AND VEHICLE USING THE SAME

(71) Applicant: Beijing FUNATE Innovation Technology Co., LTD., Beijing (CN)

(72) Inventors: Li Qian, Beijing (CN); Yu-Quan Wang, Beijing (CN)

(73) Assignee: Beijing FUNATE Innovation Technology Co., LTD., Beijing (CN)

( * ) Notice: Subject to any disclaimer, the term of this patent is extended or adjusted under 35 U.S.C. 154(b) by 291 days.

(21) Appl. No.: 14/693,895

(22) Filed: Apr. 23, 2015

(65) Prior Publication Data

US 2015/0312967 A1 Oct. 29, 2015

(30) Foreign Application Priority Data

Apr. 23, 2014 (CN) ..... 2014 1 0164341

(51) Int. Cl.
*H05B 3/84* (2006.01)
*H05B 3/14* (2006.01)

(52) U.S. Cl.
CPC ..... *H05B 3/84* (2013.01); *H05B 3/145* (2013.01); *H05B 2203/011* (2013.01); *H05B 2214/04* (2013.01)

(58) Field of Classification Search
CPC ..... B60S 1/026; B60S 1/586; H01C 17/003; H05B 2203/011; H05B 2214/04; H05B 3/145; H05B 3/84
USPC ..... 219/202, 203, 522; 428/172, 203; 427/58
See application file for complete search history.

(56) References Cited

U.S. PATENT DOCUMENTS

| | | | | |
|---|---|---|---|---|
| 4,976,503 | A * | 12/1990 | Woodard | B32B 27/36 219/203 |
| 6,660,968 | B1 * | 12/2003 | Mottelet | H05B 3/84 219/203 |
| 8,318,295 | B2 * | 11/2012 | Wang | B82Y 30/00 264/108 |
| 8,323,607 | B2 * | 12/2012 | Liu | B82B 3/0047 423/447.1 |
| 9,167,736 | B2 * | 10/2015 | Shah | H05K 9/009 |
| 9,512,545 | B2 * | 12/2016 | Zhang | B82Y 10/00 |
| 9,528,198 | B2 * | 12/2016 | Cooper | D02G 3/16 |
| 2005/0150887 | A1 * | 7/2005 | Taya | B82Y 10/00 219/548 |
| 2008/0170982 | A1 * | 7/2008 | Zhang | B82Y 10/00 423/447.3 |
| 2010/0012643 | A1 * | 1/2010 | Li | A47J 39/02 219/387 |

(Continued)

FOREIGN PATENT DOCUMENTS

| | | |
|---|---|---|
| CN | 2178579 | 10/1994 |
| CN | 101437663 | 5/2009 |

(Continued)

*Primary Examiner* — Dana Ross
*Assistant Examiner* — Joe E Mills, Jr.
(74) *Attorney, Agent, or Firm* — ScienBiziP, P.C.

(57) ABSTRACT

A defrosting glass includes a glass substrate, at least one carbon nanotube composite wire, and at least one first electrode and at least one second electrode. The carbon nanotube composite wire is disposed on the surface of the glass substrate. A carbon nanotube composite wire includes a carbon nanotube wire and a metal coating layer. Each carbon nanotube composite wire includes a carbon nanotube wire and a metal coating layer on the surface of the carbon nanotube wire.

20 Claims, 11 Drawing Sheets

(56) References Cited

U.S. PATENT DOCUMENTS

2010/0059495 A1* 3/2010 D'Haene ..... B32B 15/02 219/203
2010/0104808 A1* 4/2010 Fan ..... B82Y 30/00 428/143
2010/0323166 A1* 12/2010 Chang ..... G06F 3/0412 428/172
2011/0026750 A1* 2/2011 Wang ..... B82Y 30/00 381/335
2011/0051447 A1* 3/2011 Lee ..... F21S 48/1159 362/520
2011/0095237 A1* 4/2011 Liu ..... H01B 1/04 252/503
2011/0155713 A1 6/2011 Wang et al.
2011/0238263 A1* 9/2011 Fuse ..... B60H 1/00771 701/36
2013/0249375 A1* 9/2013 Panagotacos ..... H05B 33/0803 313/13
2014/0027433 A1* 1/2014 Lisinski ..... H05B 3/84 219/203
2014/0027434 A1* 1/2014 Reul ..... H05B 3/84 219/203
2014/0083991 A1* 3/2014 Choi ..... H05B 3/84 219/203
2014/0227551 A1* 8/2014 Rateiczak ..... H05B 3/84 428/615
2014/0263267 A1* 9/2014 Jenkins ..... E04D 13/103 219/213
2014/0329005 A1* 11/2014 Neltner ..... C23C 18/04 427/124

FOREIGN PATENT DOCUMENTS

| | | |
|---|---|---|
| CN | 101633500 | 1/2010 |
| CN | 101976594 | 2/2011 |
| CN | 102040212 | 5/2011 |
| CN | 102111926 | 6/2011 |
| CN | 103276486 | 9/2013 |
| CN | 203178958 | 9/2013 |
| TW | 200939249 | 9/2009 |
| TW | 201241843 | 10/2012 |

* cited by examiner

DEFROSTING GLASS, DEFROSTING LAMP AND VEHICLE USING THE SAME

CROSS-REFERENCE TO RELATED APPLICATIONS

This application claims priority to Chinese Patent Application No. 201410164341.2, filed on Apr. 23, 2014, the disclosure of which is incorporated herein by reference. The application is also related to copending applications entitled, "BINDING WIRE AND SEMICONDUCTOR PACKAGE STRUCTURE USING THE SAME", filed Apr. 23, 2015 U.S. Application Ser. No. 14/693,892; "CARBON NANOTUBE COMPOSITE WIRE", filed Apr. 23, 2015 U.S. Application Ser. No. 14/693,893; "HOT WIRE ANEMOMETER", filed Apr. 23, 2015 U.S. Application Ser. No. 14/693,894; "WIRE CUTTING ELECTRODE AND WIRE CUTTING DEVICE USING THE SAME", filed Apr. 23, 2015 U.S. Application Ser. No. 14/693,897; "CONDUCTIVE MESH AND TOUCH PANEL USING THE SAME", filed Apr. 23, 2015 U.S. Application Ser. No. 14/693,898; "ELECTROMAGNETIC SHIELDING MATERIAL AND CLOTHING USING THE SAME", filed Apr. 23, 2015 U.S. Application Ser. No. 14/693,899; "MASS FLOWMETER", filed Apr. 23, 2015 U.S. Application Ser. No. 14/693,901.

FIELD

The present disclosure relates to environmental engineering.

BACKGROUND

Good visibility through the windows of a vehicle is critical for safe driving. On winter days, the windows of the vehicles often have a thin layer of frost. The frost on the windows could badly affect the driver's visibility. Therefore, it is necessary to scrape the frost off the windows of the vehicle before driving.

To get rid of the frost on the windows or lamp of the vehicles, a resistance wire is coated on the windows or lamp to form a conductive layer. A voltage is applied to the conductive layer to generate heat and melt the frost. The conventional resistance wire is made of metal or alloy. However, when a diameter of the resistance wire is 1 micrometer −50 micrometers, a tensile strength of the resistance wire will be significantly reduced.

Since carbon nanotubes have good mechanical properties, carbon nanotubes are used to form the resistance wire. A conventional carbon nanotube wire comprises a plurality of microscopic carbon nanotubes connected with each other. Although the carbon nanotube wire has high mechanical strength, the connection between adjacent carbon nanotubes has high resistance, and the overall conductivity of the carbon nanotube wire is not good. Therefore, when the carbon nanotube wire is used to get rid of the frost on the windows or lamp of the vehicles, because a voltage of a vehicle power supply is smaller, usually 12 v, it is difficult to meet the heating requirements.

In order to improve the conductivity of the carbon nanotube wire, the surface of the carbon nanotube wire may be coated by a metal layer with a thickness of 1 nanometer to 50 nanometers. The electric conductivity of such a coated carbon nanotube wire is improved. However, the metal layer is thin, and is easily oxidized, so the durability of the coated carbon nanotube wire is low.

BRIEF DESCRIPTION OF THE DRAWINGS

Implementations of the present technology will now be described, by way of example only, with reference to the attached figures.

DETAILED DESCRIPTION

Figure 1:
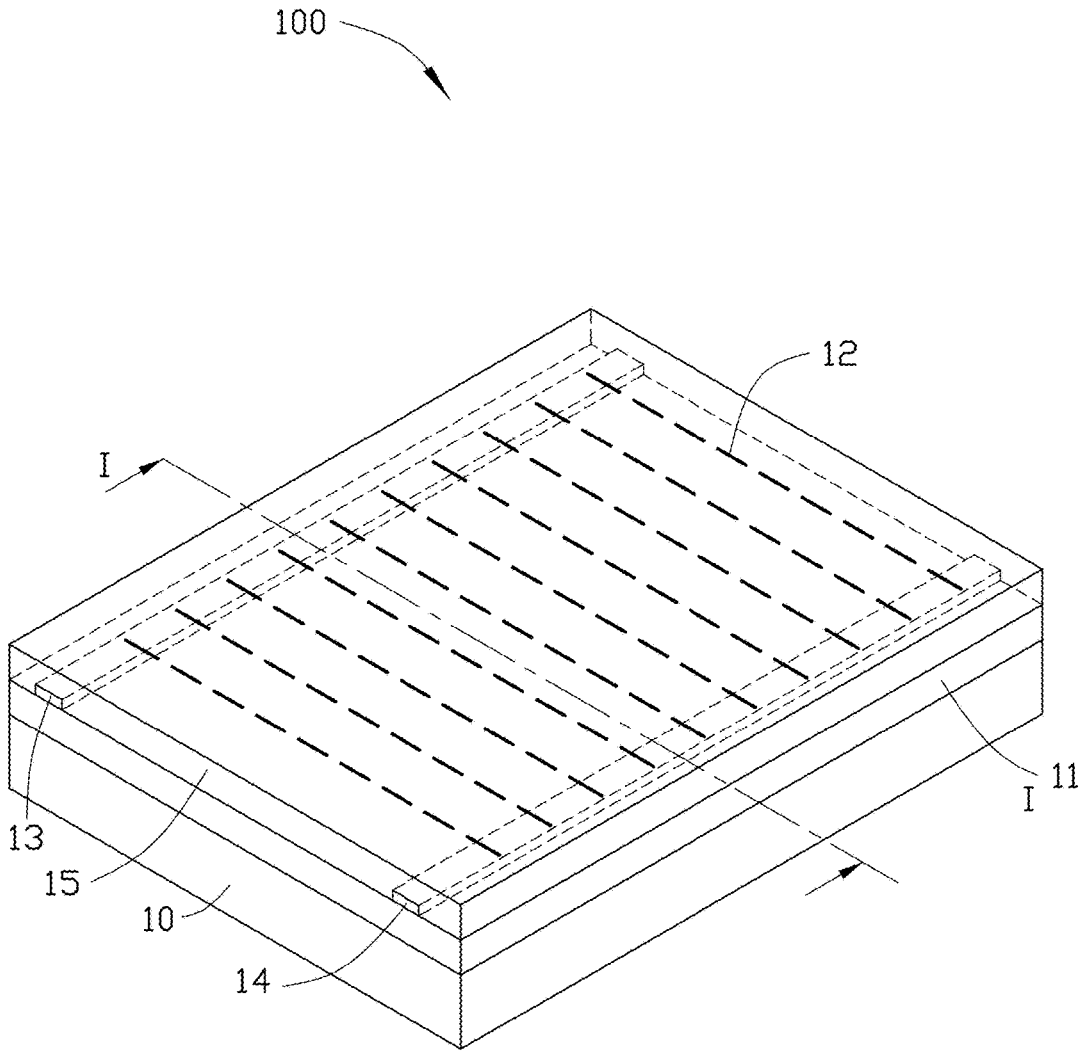
FIG. 1 is a schematic view of an embodiment of a defrosting glass.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprise" or "comprising" when utilized, means "include or including, but not necessarily limited to"; it specifically indicates open-ended inclusion or membership in the so-described combination, group, series, and the like.

Figure 2:
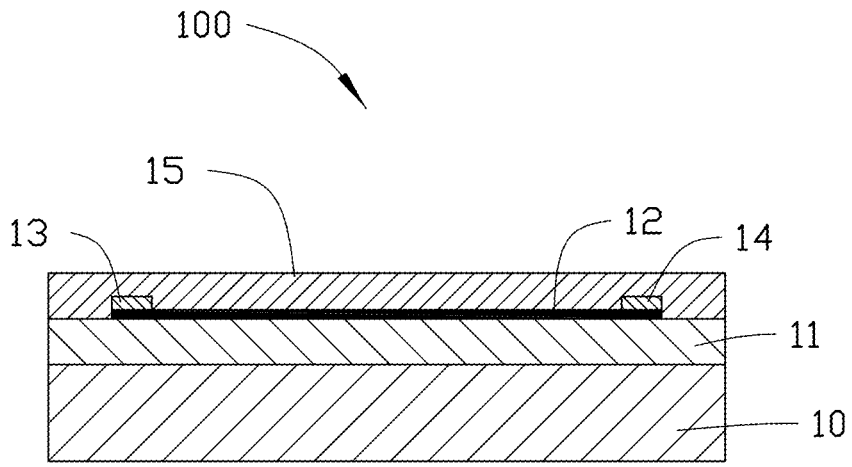
FIG. 2 is a cross-sectional view taken along a line I-I of the defrosting glass shown in FIG. 1.

Referring to FIG. 1 and FIG. 2, one embodiment of a defrosting glass 100 comprises a glass substrate 10, an adhesive layer 11, a plurality of carbon nanotube composite wires 12, a first electrode 13, a second electrode 14, and a protective layer 15. The adhesive layer 11 can be located on a surface of the glass substrate 10, to adhere the plurality of carbon nanotube composite wires 12 to the glass substrate 10. Each carbon nanotube composite wire of the plurality of carbon nanotube composite wires 12 is substantially parallel to and spaced from its neighbor on the surface of the glass substrate 10. The first electrode 13 and the second electrode 14 are located on two ends of each carbon nanotube composite wire 12, and electrically connected with the plurality of carbon nanotube composite wires 12. The protective layer 15 is disposed on surfaces of the plurality of carbon nanotube composite wires 12, and covers the first electrode 13, the second electrode 14 and the plurality of carbon nanotube composite wires 12.

The glass substrate 10 can be curved or flat and functions as a transparent support. The glass substrate 10 is used to support the adhesive layer 11 and the plurality of carbon nanotube composite wires 12. The shape and size of the glass substrate 10 is not limited and can be determined according to need. For example, the glass substrate 10 may be square, round, or triangular. In one embodiment, the glass substrate 10 is a square sheet.

The adhesive layer 11 can be applied to the surface of the glass substrate 10 by a screen-printing method. In one embodiment, the adhesive layer 11 is made of silica gel.

Figure 3:
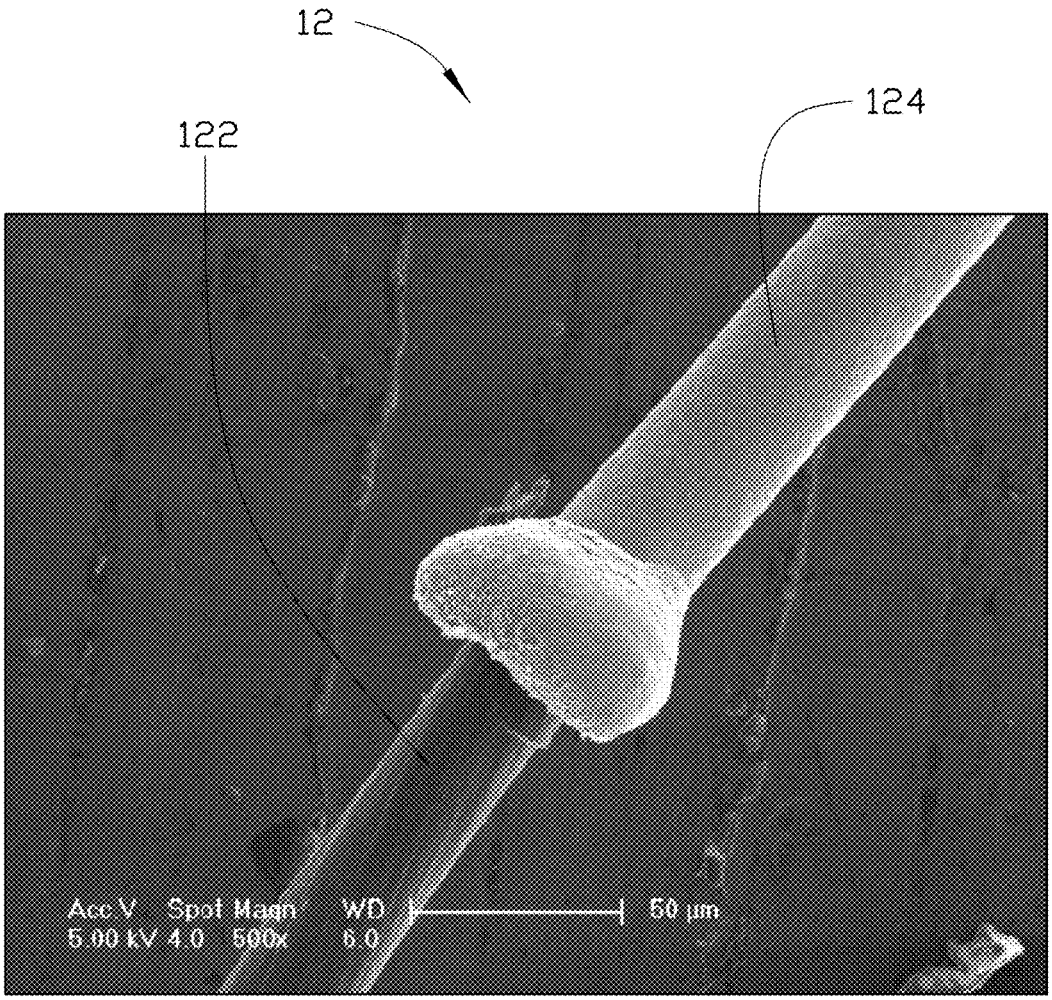
FIG. 3 is a scanning electron microscope (SEM) image of a carbon nanotube composite wire.

A carbon nanotube composite wire 12 comprises a carbon nanotube wire 122 and a metal layer 124 coated on a surface of the carbon nanotube wire 122. Referring to FIG. 3, in one embodiment, a carbon nanotube composite wire 12 consists of a carbon nanotube wire 122 and a metal layer 124 coated on the surface of the carbon nanotube wire 122.

The carbon nanotube wire 122 comprises a plurality of carbon nanotubes spirally arranged along an axial direction of the carbon nanotube wire 122. In one embodiment, the carbon nanotube wire 122 consists of a plurality of carbon nanotubes spirally arranged along the axial direction of the carbon nanotube wire 122. The plurality of carbon nanotubes are secured together by van der Waals force. The carbon nanotube wire 122 is formed by twisting a carbon nanotube film. The carbon nanotube film can be drawn from a carbon nanotube array. The carbon nanotube film comprises a plurality of carbon nanotubes parallel with each other. In one embodiment, the carbon nanotube wire can be twisted clockwise to form an S-twist; in another embodiment, the carbon nanotube wire can be twisted counterclockwise direction to form a Z-twist. The plurality of carbon nanotubes in the carbon nanotube film are substantially oriented along an axial direction of the carbon nanotube film, and joined end-to-end by van der Waals force in the axial direction of the carbon nanotube film. Therefore when the carbon nanotube film is twisted, the plurality of carbon nanotubes in the carbon nanotube wire are spirally arranged along the axial direction, joined end to end by van der Waals force in an extended direction of the plurality of carbon nanotubes.

During the twisting process of the carbon nanotube film, a space between adjacent carbon nanotubes will become smaller along the axial direction of the carbon nanotube film, and a contact area between adjacent carbon nanotubes will increase. Therefore, in the axial direction of the carbon nanotube wire 122, the van der Waals force between adjacent carbon nanotubes is increased, and adjacent carbon nanotubes in the carbon nanotube wire 122 are closely connected. In one embodiment, the space between adjacent carbon nanotubes in the axial direction of the carbon nanotube wire 122 is less than 10 nm. In one embodiment, the space between adjacent carbon nanotubes in the axial direction of the carbon nanotube wire 122 is less than 5 nm. In another embodiment, the space between adjacent carbon nanotubes in the axial direction of the carbon nanotube wire 122 is less than 1 nm. Since the space between adjacent carbon nanotubes in the axial direction of the carbon nanotube wire 122 is small, and the adjacent carbon nanotubes are closely connected by van der Waals force, the surface of the carbon nanotube wire 122 is smooth and has a high density. Since the carbon nanotube wire 122 has a smooth and dense surface structure, the metal layer 124 and the carbon nanotube wire 122 can form a close bond.

A diameter of the carbon nanotube wire 122 ranges from about 1 micrometer to about 30 micrometers. A twist of the carbon nanotube wire 122 ranges from about 10 t/cm (turns per centimeter) to about 300 t/cm). The twist is the number of turns per unit length of the carbon nanotube wire. With an increase in the twist, the space between adjacent carbon nanotubes in the axial direction of the carbon nanotube wire 122 is reduced, an attractive force between adjacent carbon nanotubes will increase. However, when the increase in the twist is too large, the attractive force between adjacent carbon nanotubes will be reduced. Thus, a predetermined twist, to the optimal diameter, gives the carbon nanotube wire 122 excellent mechanical properties.

When the diameter of the carbon nanotube wire 122 is less than 10 micrometers, the twist of the carbon nanotube wire 122 ranges from about 250 t/cm to about 300 t/cm. When the diameter of the carbon nanotube wire 122 ranges from about 10 micrometers to about 20 micrometers, the twist of the carbon nanotube wire 122 ranges from about 200 t/cm to about 250 t/cm. When the diameter of the carbon nanotube wire 122 ranges from about 25 micrometers to about 30 micrometers, the twist of the carbon nanotubes wire 122 ranges from about 100 t/cm to about 150 t/cm. The mechanical strength of the carbon nanotube wire 122 is 5 to 10 times stronger than the mechanical strength of gold wire of the same diameter. In one embodiment, the diameter of the carbon nanotube wire 122 is about 25 micrometers, and the twist of the diameter of the carbon nanotube wire 122 is about 100 t/cm.

The metal layer 124 is uniformly coated on the outer surface of the carbon nanotube wire 122. A thickness of the metal layer 124 ranges from about 1 micrometer to about 5 micrometers. When the thickness of the metal layer 124 ranges from about 1 micrometer to about 5 micrometers, the conductivity of the carbon nanotube composite wire 12 can reach 50% or more of the conductivity of the metal layer 124. When the thickness of the metal layer 124 is too small, for example less than 1 micrometer, the electrical conductivity of carbon nanotube composite wire 12 is not significantly improved. On the contrary, the metal layer 124 will be easily oxidized, and the conductivity and life of the carbon nanotube composite wire 12 will be further reduced. In addition, experiments show that when the thickness of the metal layer 124 is greater than a certain value, for example greater than 5 micrometers, the conductivity of the carbon nanotube composite wire 12 does not significantly increase along with the increase of the diameter of the carbon nanotube composite wire 12.

The material of the metal layer 124 may be a metal or metal alloy with good conductivity, such as tungsten, nickel, chromium or iron. In one embodiment, the material of the metal layer 124 is tungsten, the thickness of the metal layer 124 is about 5 micrometers. The conductivity of the carbon nanotube composite wire 12 can reach $4.39\times10^7$ S/m, and the conductivity of the carbon nanotube composite wire 12 is about 75% of the conductivity of tungsten metal.

Figure 4:
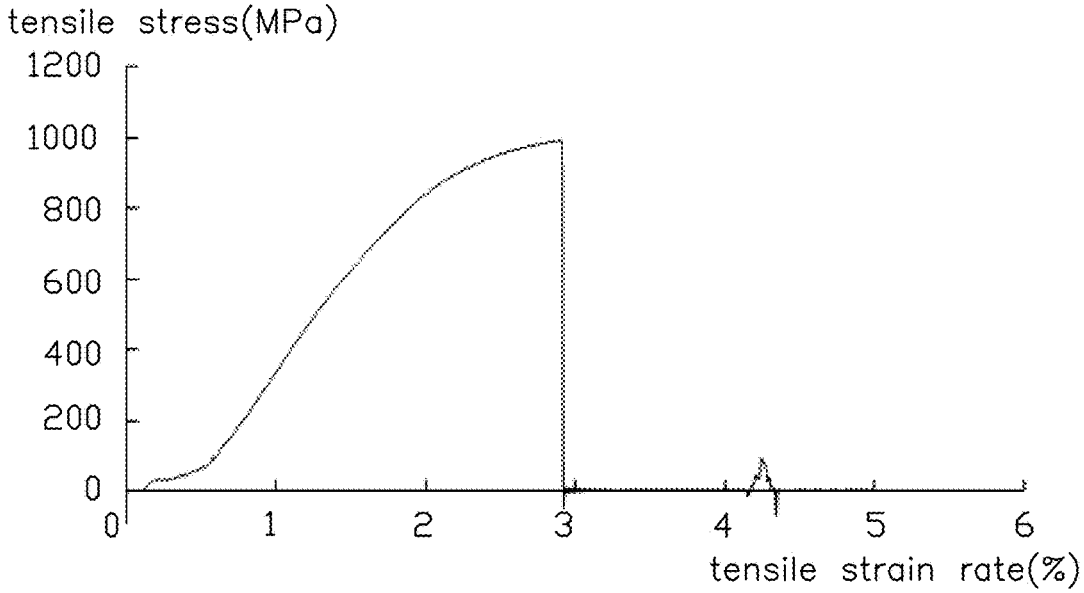
FIG. 4 is a tensile stress chart of the carbon nanotube composite wire of FIG. 3.

FIG. 3 illustrates that in one embodiment, the diameter of the carbon nanotube composite wire 12 is about 35 micrometers. FIG. 4 illustrates that tensile stresses of the carbon nanotube composite wire 12 can reach 900 MPa or more, this being 9 times of that of gold wire with same diameter.

FIG. 4 also shows that a tensile strain rate of the carbon nanotube composite wire 12 is about 3%.

The metal layer 124 can be coated on the outer surface of the carbon nanotube wire 122 by electroplating, electroless plating, or by vapor deposition method.

The first electrode 13 and the second electrode 14 are made of conductive materials. The first electrode 13 and the second electrode 14 can be conductive films, metal sheets, or metal lines, and can be made of pure metals, metal alloys, indium tin oxide (ITO), antimony tin oxide (ATO), silver paste, conductive polymer, metallic carbon nanotubes, and combinations thereof. The pure metals and metal alloys can be aluminum, copper, tungsten, molybdenum, gold, titanium, palladium, cesium, or combinations thereof. In one embodiment, the first electrode 13 and the second electrode 14 are both a conductive film structure in the shape of strips, the thickness of the conductive film ranges from about 5 nm to about 100 μm. When the first electrode 13 and the second electrode 14 are made of ITO or ATO, the first electrode 13 and the second electrode 14 are transparent.

The plurality of carbon nanotube composite wires 12 are aligned along a direction substantially perpendicular to the first electrode 13 and the second electrode 14. The first electrode 13 can be separated from the second electrode 14 to prevent a short circuit between the electrodes. When the first electrode 13 and the second electrode 14 are strips of metal sheeting, the first electrode 13 and the second electrode 14 can be electrically attached to the plurality of carbon nanotube composite wires 12 by a conductive adhesive (not shown). The first electrode 13 and the second electrode 14 are electrically contacted with each of the plurality of carbon nanotube composite wires 12, and are closely fixed on outer surfaces of each of the plurality of carbon nanotube composite wires 12 by the conductive adhesive. In some embodiments, the conductive adhesive is silver-based.

The protective layer 15 is made of a transparent polymer. The protective layer 15 can be made of cellulose, of one or more of polyethylene terephthalate (PET), acrylic resins, polyethylene, polypropylene, polystyrene, polyvinyl chloride, phenolic resin, epoxy resin, silicone, and polyester. The thickness of the protective layer 15 is not limited, and can be selected according to need. The protective layer 15 covers and protects the plurality of carbon nanotube composite wires 12, the first electrode 13, and the second electrode 14. Therefore, the plurality of carbon nanotube composite wires 12 is not easily destroyed by external force. In one embodiment, the protective layer 15 is made of epoxy resin with a thickness about 200 micrometers.

Figure 5:
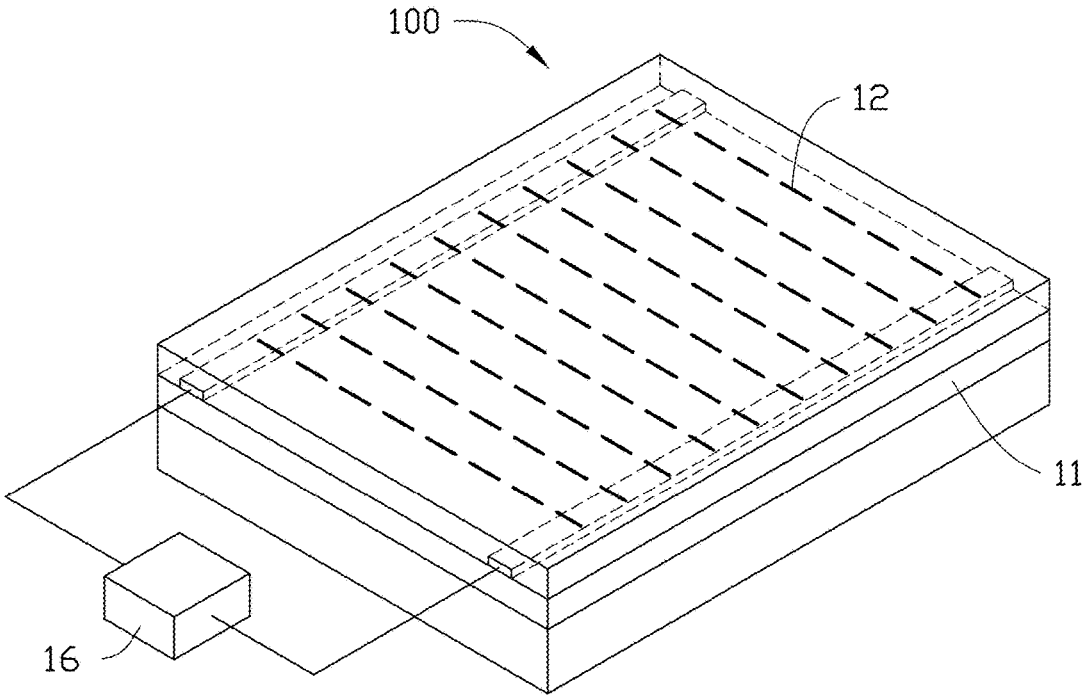
FIG. 5 is schematic view of an embodiment of a defrosting glass in application.

Referring to FIG. 5, in use, when a power source 16 is applied to the plurality of carbon nanotube composite wires 12 via the first electrode 13 and the second electrode 14, the plurality of carbon nanotube composite wires 12 radiates heat at a certain wavelength. Therefore, the heat is transmitted to the glass substrate 10. The frost on the defrosting glass 100 is melted by the heat.

The defrosting glass of some embodiment's have the following advantages. First, the diameter of the carbon nanotube wire ranges from about 1 micrometers to about 30 micrometers, and the thickness of the metal layer ranges from about 1 micrometers to about 5 micrometers. Therefore, the diameter of the carbon nanotube composite wire is smaller than that of human hair, thus the transparency of the defrosting glass is increased. Second, the carbon nanotube composite wire will exhibit an electrical skin effect, the main current will be conducted through the metal layer of the carbon nanotube composite wire. Therefore, the electrical conductivity of the carbon nanotube composite wire is significantly improved, and a heating efficiency of the defrosting glass is improved. Third, the thickness of the metal layer ranges from about 1 micrometers to about 5 micrometers, the oxidation resistance and durability of the metal layer is increased. Fourth, when the carbon nanotube composite wire is used, because the carbon nanotube has good heat resistance, even if the metal layer is fused by a high temperature, the carbon nanotube wire will not easily break, which allows the carbon nanotube composite wire to maintain an electrical connection. Therefore, the durability of the defrosting glass can be improved.

Figure 6:
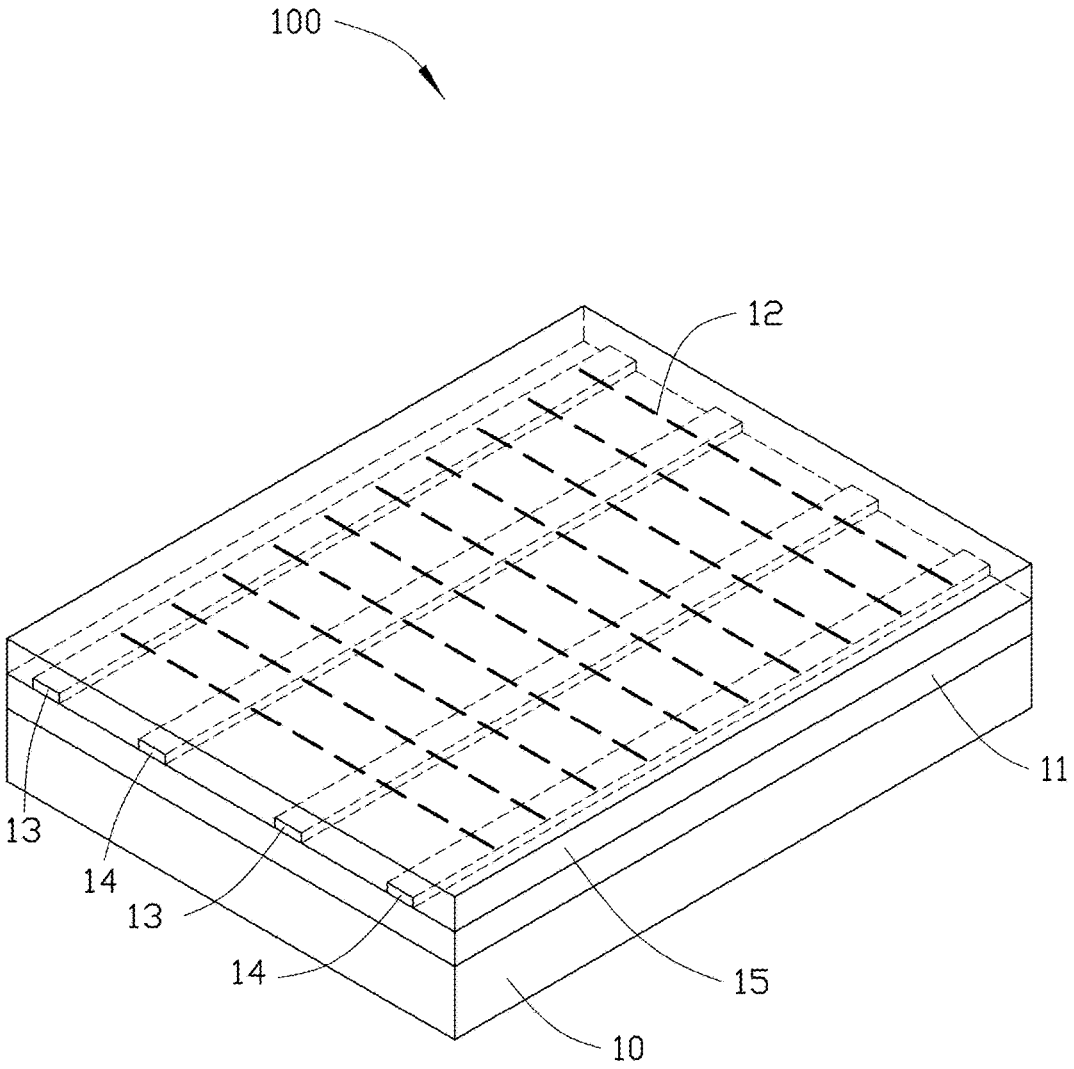
FIG. 6 is a schematic view of another embodiment of a defrosting glass.

Referring to FIG. 6, the defrosting glass 100 also can comprise plurality of alternatively arranged first and second electrodes 13 and 14. The plurality of first electrodes 13 and the plurality of second electrodes 14 are substantially parallel and spaced from each other, and can be arranged in a staggered manner, for example, side by side as shown in FIG. 6. All of the first electrodes 13 and all of the second electrodes 14 are electrically connected with the plurality of the carbon nanotube composite wires 12. In use, the plurality of first electrodes 13 and the plurality of second electrodes 14 are electrically connected with two electrodes of the power source 16 through the wires, a same electric potential difference is formed between the first electrode 13 and the adjacent second electrode 14. Therefore, a heating voltage of the plurality of the carbon nanotube composite wires 12 are reduced, an electrothermal energy conversion of the defrosting glass 100 is increased.

Figure 7:
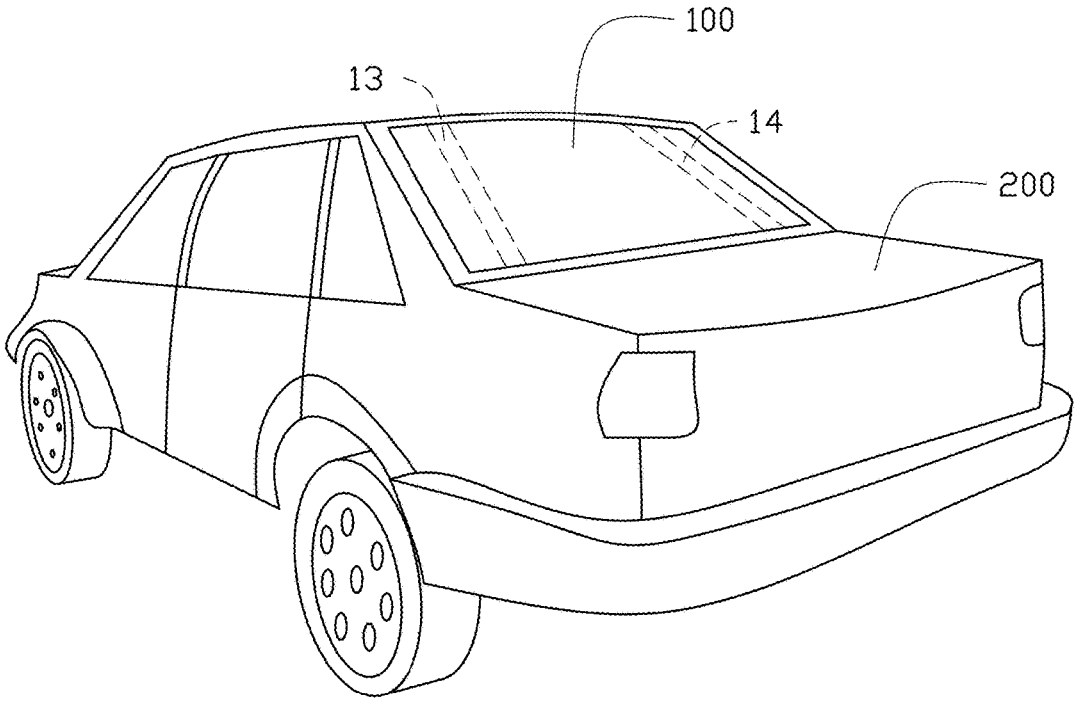
FIG. 7 is a schematic view of one embodiment of a vehicle with the defrosting glass of FIG. 1 installed.

Referring to FIG. 7, one embodiment of a vehicle 200 with the defrosting glass 100 is provided. The defrosting glass 100 is used as the back window of the vehicle 200. The glass substrate 10 of the defrosting glass 100 have a first surface and a second surface opposite to the first surface. The first surface of the glass substrate 10 bears the plurality of the carbon nanotube composite wires 12, and faces the inside of the vehicle 200. The second surface of the glass substrate 10 faces outside the vehicle 200. The first electrode 13 and the second electrode 14 are electrically connected with an electrical source system of the vehicle 200. The defrosting glass 100 can also be used as the front or side windows of the vehicle 200, because the defrosting glass 100 is transparent.

Figure 8:
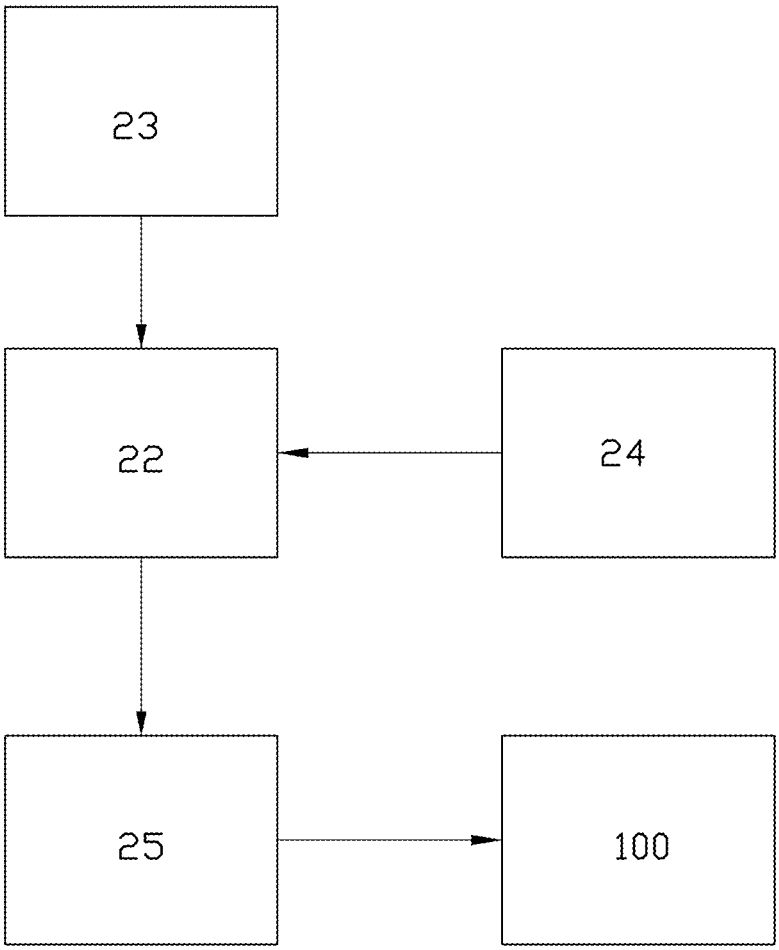
FIG. 8 is a schematic view of one embodiment of a defrosting system with the defrosting glass used in a vehicle.

Referring to FIG. 8, in use, the vehicle 200 further includes a control system 22, a switch 23, a sensor 24, and an electrical source 25. The control system 22 is electrically connected with the electrical source 25, to control a voltage of the electrical source 25. The electrical source 25 is electrically connected with the defrosting glass 100 via the first electrode 13 and the second electrode 14, thus a voltage can be applied on the defrosting glass 100. The switch 23 is electrically connected with the control system 22 and can be controlled by an operator of the vehicle 200. The sensor 24 is electrically connected with the control system 22, and can detect the presence of frost on the defrosting glass 100. When there is frost on the surface of the defrosting glass 100, the sensor 24 will send a signal to the control system 22, whereby the control system 22 will control the defrosting glass 100 to work.

Figure 9:
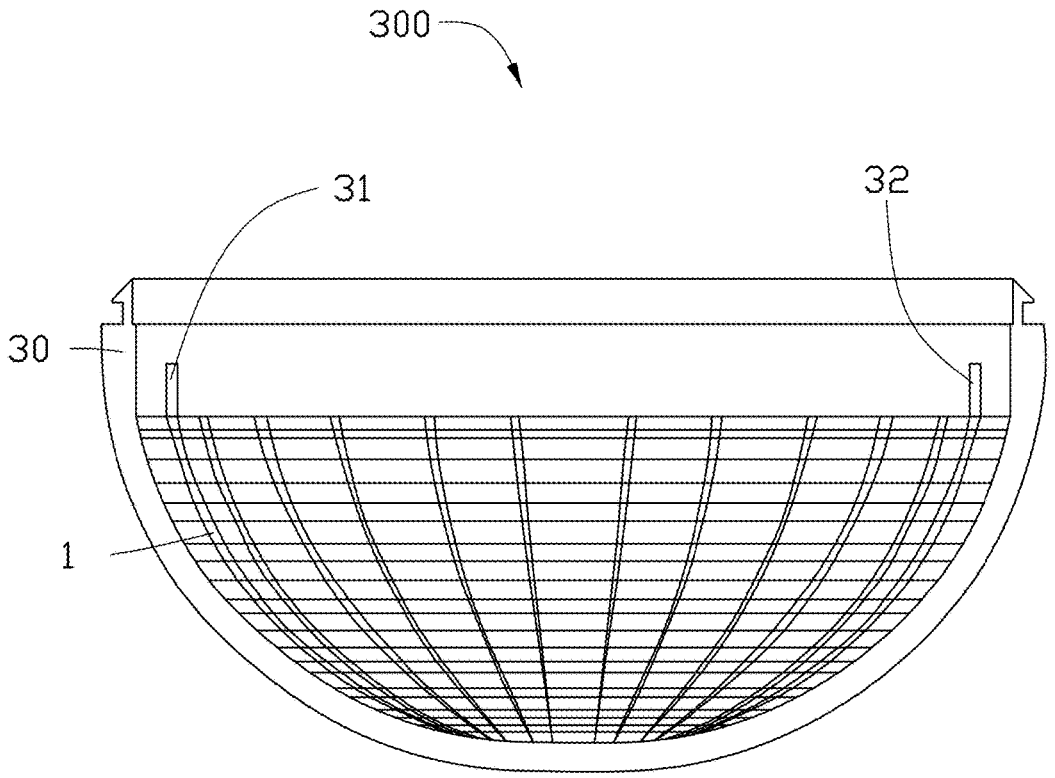
FIG. 9 is a schematic view of an embodiment of a defrosting lamp.

Referring to FIG. 9, one embodiment of a defrosting lamp 300 is provided. The defrosting lamp 300 comprises a lampshade 30, a plurality of carbon nanotube composite wires 12, a first electrode 31, and a second electrode 32. Each of the plurality of carbon nanotube composite wires 12 is disposed in the inner surface of the lampshade 30, and each is spaced from another. The first electrode 31 and the second electrode 32 are electrically connected with the plurality of carbon nanotube composite wires 12.

The shape and the material of the lampshade 30 are not limited, these can be selected according to need. In one embodiment, the shape of the lampshade 30 is hemispherical.

The plurality of carbon nanotube composite wires 12 are spaced from each other along the meridian or weft direction of the lampshade 30. Each adjacent carbon nanotube composite wires 12 are electrically connected. In this embodiment, the plurality of carbon nanotube composite wires 12 are spaced from each other along the meridian direction. The plurality of carbon nanotube composite wires 12 are disposed in the inner surface of the lampshade 30 by an adhesive, grooves, or bulges on the inner surface of the lampshade 30. In one embodiment, a plurality of grooves are extended along the meridian direction on the inner surface of the lampshade 30, and the plurality of the carbon nanotube composite wires 12 are disposed on the inner surface of the lampshade 30, in the plurality of grooves.

The material and structure of the first electrode 31 and of the second electrode 32 are same as those of the first electrode 13 and the second electrode 14.

Figure 10:
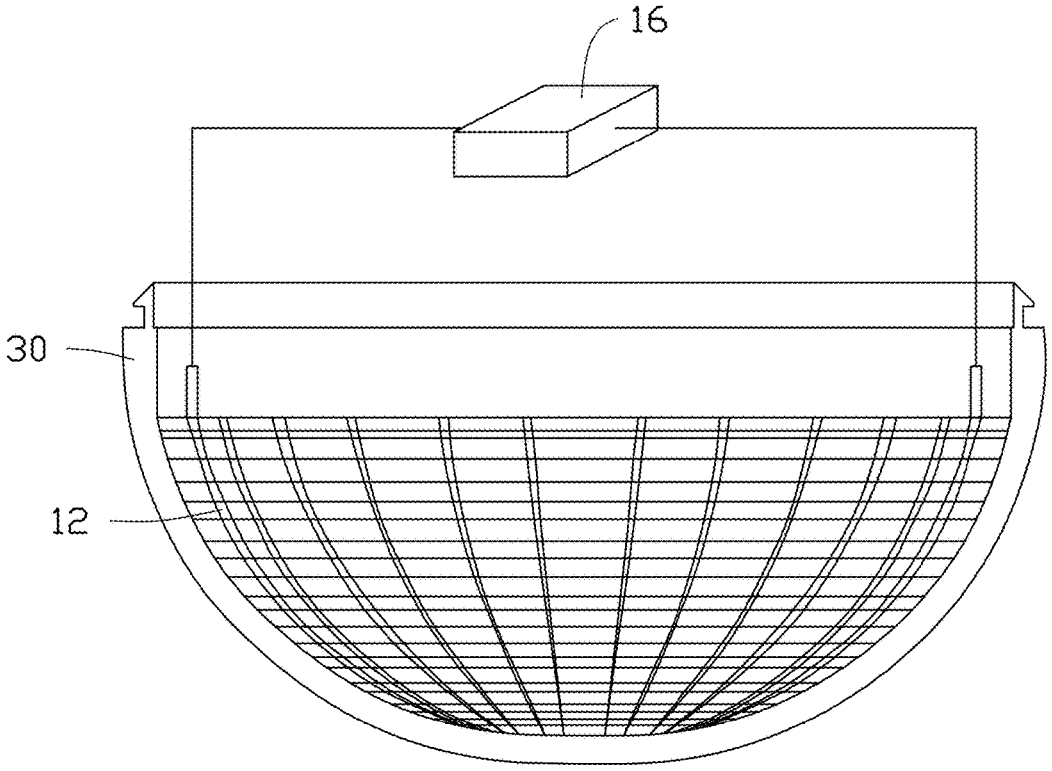
FIG. 10 is schematic view of an embodiment of the defrosting lamp of FIG. 9 in operation.

Referring to FIG. 10, in use, when a power source 16 is applied to the plurality of carbon nanotube composite wires 12 via the first electrode 31 and the second electrode 32, the plurality of carbon nanotube composite wires 12 radiates heat at a certain wavelength. The heat is transmitted to the lampshade 30 to melt the frost on the lampshade 30.

In one embodiment of a vehicle 400 (not shown) with the defrosting lamp 300 is provided. The first electrode 31 and the second electrode 32 are electrically connected with an electrical source system of the vehicle. The defrosting lamp 300 can be used as a fully-functioning lamp of the vehicle 200, because the defrosting lamp 300 is transparent.

Figure 11:
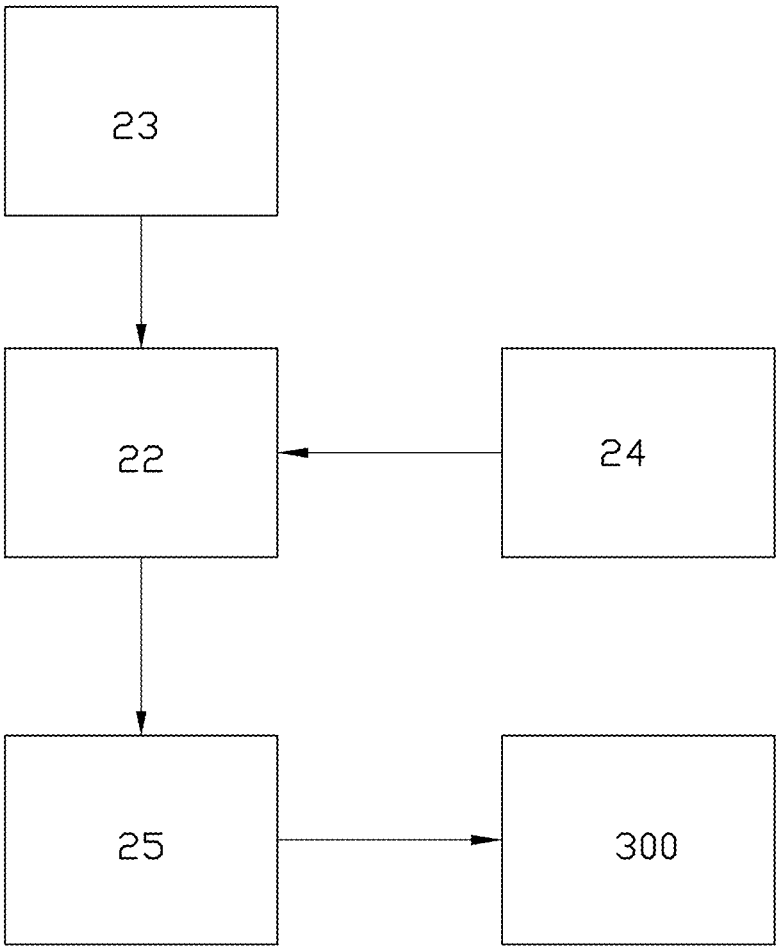
FIG. 11 is a schematic view of one embodiment of a defrosting system with the defrosting lamp of FIG. 9 used in a vehicle.

Referring to FIG. 11, in use, the vehicle 400 further includes a control system 22, a switch 23, a sensor 24, and an electrical source 25. The control system 22 is electrically connected with the electrical source 25, to control a voltage of the electrical source 25. The electrical source 25 is electrically connected with the defrosting lamp 300 via the first electrode 31 and the second electrode 32, thus a voltage can be applied to the defrosting lamp 300. The switch 23 is electrically connected with the control system 22 and can be controlled by an operator of the vehicle 400. The sensor 24 is electrically connected with the control system 22, and can detect any frost on the defrosting lamp 300. When there is frost on the surface of the defrosting lamp 300, the sensor 24 will send a signal to the control system 22, whereby the control system 22 will control the defrosting lamp 300 to work.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A defrosting glass, comprising:

a glass substrate having a substrate surface;

at least one carbon nanotube composite wire deposed on the substrate surface;

at least one first electrode and at least one second electrode, spaced from each other, electrically connected with the at least one carbon nanotube composite wire; and wherein each of the at least one carbon nanotube composite wire comprises a carbon nanotube wire and a metal layer made of metal or metal alloy; the carbon nanotube wire comprises a plurality of carbon nanotubes spirally arranged along an axial direction of the carbon nanotube wire, a diameter of the carbon nanotube wire ranges from 1 micrometer to 30 micrometers, and a twist of the carbon nanotube wire ranges from 250 t/cm to 300 t/cm; and the metal layer is coated on a carbon nanotube wire surface of the carbon nanotube wire, and a thickness of the metal layer ranges from 1 micrometer to 5 micrometers.

2. The defrosting glass of claim 1, wherein the diameter of the carbon nanotube wire is less than 10 micrometers, and the twist of the carbon nanotube wire ranges from 10 t/cm to 300 t/cm.

3. The defrosting glass of claim 1, wherein the diameter of the carbon nanotube wire ranges from 25 micrometers to 30 micrometers, and the twist of the carbon nanotube wire ranges from 100 t/cm to 150 t/cm.

4. The defrosting glass of claim 1, wherein the at least one carbon nanotube composite wire comprises a plurality of carbon nanotube composite wires, and the plurality of carbon nanotube composite wires are parallel and spaced from each other.

5. The defrosting glass of claim 1, wherein a material of the metal layer is tungsten, and the thickness of the metal layer is 5 micrometers.

6. A vehicle, comprising:

at least one defrosting glass comprising:

a glass substrate having a substrate surface;

at least one carbon nanotube composite wire deposed on the substrate surface;

at least one first electrode and at least one second electrode, spaced from each other, electrically connected with the at least one carbon nanotube composite wire;

an electrical source electrically connected with the at least one first electrode and the at least one second electrode, to apply electrical current to the at least one carbon nanotube composite wire;

a control system electrically connected with the electrical source and controlling a voltage of the electrical source;

a switch electrically connected with the control system;

a sensor electrically connected with the control system and detecting frost on the at least one defrosting glass, and wherein each of the at least one carbon nanotube composite wire comprises a carbon nanotube wire and a metal layer made of metal or metal alloy; the carbon nanotube wire comprises a plurality of carbon nanotubes spirally arranged along an axial direction of the carbon nanotube wire, a diameter of the carbon nanotube wire ranges from 1 micrometer to 30 micrometers, and a twist of the carbon nanotube wire ranges from 250 t/cm to 300 t/cm; and the metal layer is coated on a carbon nanotube wire surface of the carbon nanotube wire, and a thickness of the metal layer ranges from 1 micrometer to 5 micrometers.

7. The vehicle of claim 6, wherein the diameter of the carbon nanotube wire is less than 10 micrometers, and the twist of the carbon nanotube wire ranges from 10 t/cm to 300 t/cm.

8. The vehicle of claim 6, wherein the diameter of the carbon nanotube wire ranges from 25 micrometers to 30 micrometers, and the twist of the carbon nanotube wire ranges from 100 t/cm to 150 t/cm.

9. The vehicle of claim 6, wherein a material of the metal layer is tungsten, and the thickness of the metal layer is 5 micrometers.

10. A defrosting lamp, comprising:

a lampshade having an inner surface;

at least one carbon nanotube composite wire composite wire deposed on the inner surface of the lampshade; and at least one first electrode and at least one second electrode, spaced from each other, electrically connected with the at least one carbon nanotube composite wire;

wherein each of the at least one carbon nanotube composite wire comprises a carbon nanotube wire and a metal layer made of metal or metal alloy; the carbon nanotube wire comprises a plurality of carbon nanotubes spirally arranged along an axial direction of the carbon nanotube wire, a diameter of the carbon nanotube wire ranges from 1 micrometer to 30 micrometers, and a twist of the carbon nanotube wire ranges from 250 t/cm to 300 t/cm; and the metal layer is coated on a surface of the carbon nanotube wire, and a thickness of the metal layer ranges from 1 micrometer to 5 micrometers.

11. The defrosting lamp of claim 10, wherein the diameter of the carbon nanotube wire is less than 10 micrometers, and the twist of the carbon nanotube wire ranges from 10 t/cm to 300 t/cm.

12. The defrosting lamp of claim 10, wherein the diameter of the carbon nanotube wire ranges from 25 micrometers to 30 micrometers, and the twist of the carbon nanotube wire ranges from 100 t/cm to 150 t/cm.

13. The defrosting lamp of claim 10, wherein a material of the metal layer is tungsten, and the thickness of the metal layer is 5 micrometers, and a conductivity of each of the at least one carbon nanotube composite wire is $4.39\times10^7$ S/m and is 75% of a conductivity of metal layer.

14. The defrosting lamp of claim 10, wherein the plurality of carbon nanotubes in each of the at least one carbon nanotube wire are joined end to end by van der Waals force in an extended direction of the plurality of carbon nanotubes.

15. The defrosting glass of claim 1, wherein the twist of the carbon nanotube wire is 10 t/cm.

16. The defrosting glass of claim 1, wherein a conductivity of the carbon nanotube composite wire is greater than 50% of a conductivity of the metal layer.

17. The defrosting glass of claim 1, wherein the material of the metal layer is tungsten, the thickness of the metal layer is 5 micrometers, and a conductivity of each of the at least one carbon nanotube composite wire is $4.39\times10^7$ S/m and is 75% of a conductivity of metal layer.

18. The defrosting glass of claim 1, wherein the diameter of each of the at least one carbon nanotube composite wire is 35 micrometers, and a tensile stress of each of the at least one carbon nanotube composite wire is 900 MPa.

19. The defrosting glass of claim 1, wherein a material of the metal layer is selected from the group consisting of tungsten, nickel, chromium and iron.

20. The defrosting glass of claim 6, wherein the diameter of each of the at least one carbon nanotube composite wire is 35 micrometers, and a tensile stress of each of the at least one carbon nanotube composite wire is 900 MPa.

* * * * *